US005607913A

United States Patent [19]

Woo et al.

[11] Patent Number: 5,607,913

[45] Date of Patent: Mar. 4, 1997

[54] ACIDIC LIQUID DETERGENT COMPOSITIONS FOR BATHROOMS

[75] Inventors: Ricky A. Woo, Hamilton; James E. Gray, Cincinnati, both of Ohio

[73] Assignee: The Procter & Gamble Company, Cincinnati, Ohio

[21] Appl. No.: 342,557

[22] Filed: Nov. 21, 1994

Related U.S. Application Data

[62] Division of Ser. No. 96,533, Jul. 22, 1993.

[51] Int. Cl.[6] ..... C11D 1/72; C11D 1/722; C11D 1/94

[52] U.S. Cl. ..... 510/413; 510/414; 510/422; 510/423; 510/424; 510/432; 510/434; 134/40

[58] Field of Search ..... 252/142, 143, 252/546, 548, 174.19, 174.21, 174.22; 134/40; 510/422, 423, 424, 432, 434, 413, 414

[56] References Cited

U.S. PATENT DOCUMENTS

| | | | |
|---|---|---|---|
| 3,935,130 | 1/1976 | Hirano et al. | 252/542 |
| 3,962,149 | 6/1976 | Chirash et al. | 252/540 |
| 3,993,575 | 11/1976 | Howanitz | 252/142 |
| 4,247,408 | 1/1981 | Imamura et al. | 252/143 |
| 4,501,680 | 2/1985 | Aszman et al. | 252/142 |
| 4,581,161 | 4/1986 | Nedonchelle | 252/550 |
| 4,612,135 | 9/1986 | Wenzel | 252/106 |
| 4,759,865 | 7/1988 | Malihi | 252/175 |
| 4,944,892 | 7/1990 | Leathers et al. | 252/92 |
| 5,008,030 | 4/1991 | Cook et al. | 252/106 |
| 5,061,393 | 10/1991 | Linares et al. | 252/143 |
| 5,075,026 | 12/1991 | Loth et al. | 252/122 |
| 5,256,327 | 10/1993 | Allen et al. | 252/90 |
| 5,258,132 | 11/1993 | Kamel et al. | 252/94 |
| 5,264,047 | 11/1993 | Winston et al. | 134/42 |
| 5,362,422 | 11/1994 | Masters | 252/544 |
| 5,376,298 | 12/1994 | Michael | 252/153 |
| 5,384,063 | 1/1995 | Woo et al. | 252/142 |

FOREIGN PATENT DOCUMENTS

| | | | |
|---|---|---|---|
| 894543 | 3/1983 | Belgium . | |
| 0125854A2 | 11/1984 | European Pat. Off. | C11D 1/83 |
| 0162600A1 | 11/1985 | European Pat. Off. | C11D 1/88 |
| 0496188A1 | 7/1992 | European Pat. Off. | C11D 3/20 |
| 62-235399A | 10/1987 | Japan | C11D 1/72 |

*Primary Examiner*—Paul Lieberman
*Assistant Examiner*—Gregory R. Delcotto
*Attorney, Agent, or Firm*—Robert B. Aylor

[57] ABSTRACT

Detergent compositions comprising a surfactant system that is either (1) a mixture of zwitterionic detergent surfactant and/or amphoteric (non-zwitterionic) detergent surfactant with nonionic detergent surfactant; or (2) short chain nonionic detergent surfactant; a suds reducing amount of a suds controlling alkoxylated material of the formula: $C_n(PO)_x(EO)_y(PO)_z$ in which $C_n$ is a hydrocarbon group containing n carbon atoms, n is a number from about 6 to about 12, x is a number from about 1 to about 6, y is a number from about 4 to about 15, and z is a number from about 4 to about 25; optional, but preferred, hydrophobic cleaning solvent; and polycarboxylate, especially dicarboxylate, detergent builder, provide superior cleaning of all of the soils commonly found in the bathroom while maintaining a desirable low suds profile and good rinsing properties. The compositions have a pH of from about 1 to about 5.5, preferably from about 2 to about 4 when the dicarboxylate builder is used. The compositions are in the form of aqueous liquids.

18 Claims, No Drawings

ACIDIC LIQUID DETERGENT COMPOSITIONS FOR BATHROOMS

This a division of application Ser. No. 08/096,533, filed on Jul. 22, 1993.

FIELD OF THE INVENTION

This invention pertains to acidic liquid detergent compositions for bathrooms. Such compositions typically contain detergent surfactants, detergent builders, and/or solvents to accomplish their cleaning tasks.

BACKGROUND OF THE INVENTION

The use of acidic cleaning compositions containing organic water-soluble synthetic detergents, solvents, and/or detergent builders for bathroom cleaning tasks are known. However, such compositions are not usually capable of providing superior hard surface cleaning for all of the soils encountered in a bathroom. An exception is the compositions of U.S. Pat. No. 5,061,393, Linares and Cilley, issued Oct. 29, 1991, said patent being incorporated herein by reference.

The object of the present invention is to provide additional detergent compositions which also provide good and/or improved cleaning for all of the usual hard surface cleaning tasks found in the bathroom including the removal of hard-to-remove soap scum and hard water deposits.

SUMMARY OF THE INVENTION

The present disclosure relates to an aqueous, acidic hard surface detergent composition comprising: (a) a detergent surfactant system which comprises either: (1) a mixture of. zwitterionic detergent surfactant-as disclosed in U.S. Pat. No. 5,061,393, preferably a fatty acyl amidoalkylenebetaine, and/or amphoteric (non-zwitterionic) detergent surfactant, preferably N-($C_{8-14}$acylamidoalkylene)amidoglycinate, with nonionic detergent surfactant; or, less desirably, (2) a low sudsing, nonionic detergent surfactant in (1) and that is a $C_{7-10}E_{3-12}$, preferably $C_{8-10}E_{3-8}$, nonionic detergent surfactant at a level of at least about 0.1%, preferably from about 1% to about 5%, the nonionic detergent surfactant in (1) and (2) preferably being either a $C_8$ or mixture of $C_8$ and $C_{10}$ alkyl nonionic detergent surfactants with the $C_8$ being at least about 0.1% of the mixture; (b) a suds reducing amount of a $C_n(PO)_x(EO)_y(PO)_z$ compound in which n is a number from about 6 to about 12, preferably from about 6 to about 10, x is a number from about 1 to about 6, preferably from about 2 to about 4; y is a number from about 4 to about 15, preferably from about 5 to about 12; and z is a number from about 4 to about 25, preferably from about 6 to about 20, (c) optionally, but preferably, hydrophobic solvent that provides a primary cleaning function, preferably butoxypropoxypropanol, and/or, e.g., the other solvents described in U.S. Pat. No. 5,061,393; and (d) polycarboxylate detergent builder, preferably a dicarboxylic acid, having two carboxyl groups separated by from about 1 to about 4 carbon atoms, preferably as methylene groups, with said polycarboxylate detergent builder preferably containing at least about 2%, preferably from about 2% to about 14% by weight of the composition, of said dicarboxylic acid, especially when detergent surfactant system (1) is present, and said composition having a pH of from about 1 to about 5.5, preferably from about 2 to about 4 when said dicarboxylic acid detergent builder is present.

The compositions can also contain an optional buffering system to help maintain the acidic pH and the balance typically being an aqueous solvent system and minor ingredients. The compositions can be formulated either as concentrates, or at usage concentrations, either thickened or unthickened, and can be packaged in a container having means for creating a spray or foam to make application to hard surfaces more convenient.

DETAILED DESCRIPTION OF THE INVENTION (a) The Detergent Surfactant Systems

In accordance with the present invention, the detergent surfactant system is selected from the group consisting of: (1) mixtures of zwitterionic detergent surfactant as set forth in U.S. Pat. No. 5,061,393, and/or certain amphoteric (non-zwitterionic) detergent surfactant, preferably glycinate, as disclosed in detail hereinafter, with nonionic detergent surfactant, preferably modified to contain the short chain nonionicdetergent surfactants discussed in more detail hereinafter; or (2) low sudsing, short chain, nonionic detergent surfactant which has a short, e.g., $C_{7-10}$, alkyl chain, the amount of ethoxylation being selected, e.g., from about 3 to about 12, to give the appropriate HLB and the content of said short chain nonionic detergent surfactant being at least about 0.1%. As mentioned hereinbefore, these shorter chain nonionic detergent surfactants are also superior for use with the zwitterionic and/or amphoteric (non-zwitterionic) detergent surfactants.

The varied types of soils that may be encountered include oily/greasy soils and soap scum. The detergent surfactant systems of this invention provide good performance for all of the common types of soil encountered in the bathroom.

Zwitterionic Detergent Surfactants

Zwitterionic detergent surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc., can be used. A generic formula for some preferred zwitterionic detergent surfactants is:

$$R—N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl )-2-hydroxy-propane-1-sulfonate, available from the Sherex Company under the trade name "Varion HC."

Other specific zwitterionic detergent surfactants have the generic formula:

$$R—C(O)—N(R^2)—(CR^3{}_2)_n—N(R^2)_2{}^{(+)}—(CR^3{}_2)_n—SO_3{}^{(-)}$$

wherein each R is a hydrocarbon, e.g., an alkyl group containing from about 8 up to about 20, preferably up to about 18, more preferably up to about 16 carbon atoms, each ($R^2$) is either a hydrogen (when-attached to the amido nitrogen), short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10-14}$ fatty acylamidopropylene(hydroxypropylene)sulfobetaine that is available from the Sherex Company under the trade name "Varion CAS Sulfobetaine".

Compositions of this invention containing the above hydrocarbyl amido sulfobetaine (HASB) can contain more perfume and/or more hydrophobic perfumes than similar compositions containing conventional anionic detergent surfactants. This can be desirable in the preparation of consumer products. Perfumes useful in the compositions of this invention are disclosed in more detail hereinafter.

Other zwitterionic detergent surfactants useful, and, surprisingly, preferred, herein include hydrocarbyl, e.g., fatty, amidoalkylenebetaines (hereinafter also referred to as "HAB"). These detergent surfactants, which are more cationic at the pH of the composition, have the generic formula:

$$R—C(O)—N(R^2)—(CR^3_2)_n—N(R^2)_2^{(+)}—(CR^3_2)_n—C(O)O(-)$$

wherein each R is a hydrocarbon, e.g., an alkyl group containing from about 8 up to about 20, preferably up to about 18, more preferably up to about 16 carbon atoms, each ($R^2$) is either a hydrogen (when attached to the amido nitrogen), short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3_2$) moiety. The R groups can be branched and/or unsaturated, and such structures can provide spotting/filming benefits, even when used as part of a mixture with straight chain alkyl R groups. An example of such a detergent surfactant is a $C_{10-14}$ fatty acylamidopropylenebetaine available from the Miranol Company under the trade name "Mirataine CB."

The level of zwitterionic detergent surfactant, when present in the composition, is typically from about 0.01% to about 8%, preferably from about 1% to about 6%, more preferably from about 2% to about 4%. The level in the composition is dependent on the eventual level of dilution to make the wash solution. For cleaning, the composition, when used full strength, or the wash solution containing the composition, should contain from about 0.01% to about 8%, preferably from about 1% to about 6%, more preferably from about 2% to about 4%, of the zwitterionic detergent surfactant. Concentrated products will typically contain from about 0.02% to about 16%, preferably from about 4% to about 8% of the zwitterionic detergent surfactant.

Nonionic Detergent Surfactant or Cosurfactant

Compositions of this invention contain nonionic detergent surfactant, either alone, when the nonionic detergent surfactant is low sudsing as described hereinafter, or as part of a mixture with a zwitterionic, or amphoteric, detergent surfactant ("cosurfactant") to provide cleaning and emulsifying benefits over a wide range of soils. Nonionic detergent surfactants useful herein include any of the well-known nonionic detergent surfactants that have an HLB of from about 6 to about 18, preferably from about 8 to about 16, more preferably from about 8to about 10. For optimum low sudsing, the preferred nonionic detergent surfactant is either an octyl polyethoxylate, or mixtures of octyl and decyl polyethoxylates with from about 0.1% to about 15%, preferably from about 1% to about 5%, of said octyl polyethoxylate.

Typical of these nonionic detergent surfactants are alkoxylated (especially ethoxylated) alcohols and alkyl phenols, and the like, which are well-known from the detergency art. In general, such nonionic detergent surfactants contain an alkyl group in the $C_{7-22}$, preferably $C_{8-10}$, more preferably all $C_8$ or mixtures of $C_{8-10}$, as discussed hereinbefore, and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include:-octyl polyethoxylates (2.5) and (5); decyl polyethoxylates (2.5) and (5); decyl polyethoxylate (6); mixtures of said octyl and decyl polyethoxylates with at least about 10%, preferably at least about 30%, more preferably at least about 50%, of said octyl polyethoxylate; and coconut alkyl polyethoxylate (6.5).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS., North American Edition, 1984, McCutcheon Division, MC Publishing Company, also incorporated herein by reference.

The nonionic surfactant component can comprise as little as 0.01% of the compositions herein, especially when used with another detergent surfactant, but typically the compositions will contain from about 0.5% to about 6%, more preferably from about 1% to about 4%, of nonionic cosurfactant, and when the short chain $C_8$ or $C_{7-10}$ polyethoxylate detergent surfactant is used alone, the amount is from about 0.1% to about 15%, preferably from about 1% to about 8%, more preferably from about 2% to about 6%.

The ratio of nonionic surfactant to zwitterionic or amphoteric (non-zwitterionic) detergent surfactant is typically from about 1:4 to about 3:1, preferably from about 1:3 to about 2:1, more preferably from about 1:2 to about 1:1.

Amphoteric (Non-zwitterionic) Detergent Surfactant

These detergent surfactants are similar to the zwitterionic detergent surfactants, but without the quaternary group. However, they contain an amine group that is protonated at the low pH of the composition (below pH 5.5), to form a cationic group, and they may also possess an anionic group at these pHs.

One suitable amphoteric detergent surfactant is a $C_{8-14}$ amidoalkylene glycinate detergent surfactant. These detergent surfactants are essentially cationic at the acid pH.

The glycinate detergent surfactants herein preferably have the generic formula, as an acid, of:

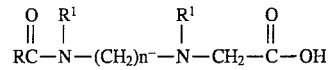

wherein

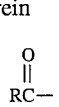

is a $C_{8-14}$, preferably $C_{8-10}$, hydrophobic fatty acyl moiety containing from about 8 to about 14, preferably from about 8 to about 10, carbon atoms which, in combination with the nitrogen atom, forms an amido group, each n is from 1 to 3, and each $R^1$ is hydrogen (preferably) or a $C_{1-2}$ alkyl or hydroxy alkyl group. Such detergent surfactants are available, e.g., in the salt form, for example, from Sherex under the trade name Rewoteric AM-V, having the formula:

$$C_7C(O)NH(CH_2)_2N(CH_2CH_2OH)CH_2C(O)O^{(-)}Na^{(+)}.$$

Not all amphoteric detergent surfactants are acceptable. Longer chain glycinates and similar substituted amino propionates provide a much lower level of cleaning. Such propionates are available as, e.g., salts from Mona Industries, under the trade name Monateric 1000, having the formula:

$$C_7C(O)NH(CH_2)_2N(CH_2CH_2OH)CH_2CH_2C(O)O^{(-)}Na^{(+)}.$$

Cocoyl amido ethyleneamine-N-(hydroxyethyl)-2-hydroxypropyl-1-sulfonate (Miranol CS); $C_{8-10}$ fatty acyl amidoethyleneamine-N-(methyl)ethyl sulfonate; and analogs and homologs thereof, as their water-soluble salts, or acids, are amphoterics that provide good cleaning. Preferably, these amphoterics are combined with the short chain nonionic detergent surfactants to minimize sudsing.

Examples of other suitable amphoteric (non-zwitterionic) detergent surfactants include:

cocoylamido ethyleneamine-N-(methyl)-acetates;

cocoyl amido ethyl eneamine-N-(hydroxyethyl)-acetates;

cocoylamido propyl amine-N-hydroxyethyl)-acetates; and analogs and homologs thereof, as their water-soluble salts, or acids, are suitable.

(b) The Suds Controlling Alkoxylated Material

This material is both a suds regulant and a detergent surfactant. The formula for these compounds is: $C_n(PO)_x(EO)_y(PO)_z$ in which $C_n$ represents a hydrophobic group, preferably a hydrocarbon group containing n carbon atoms, n is a number from about 6 to about 12, preferably from about 6 to about 10, is a number from about 1 to about 6, preferably from about 2 to about 4; y is a number from about 4 to about 15, preferably from about 5 to about 12; and z is a number from about 4 to about 25, preferably from about 6 to about 20. These compounds are included in a suds regulating amount to provide good suds control while maintaining good spotting/filming and rinsing characteristics. The usual amount of material present is from about 0.1% to about 5%, preferably from about 0.5% to about 2%. These materials are used in addition to the nonionic detergent surfactant.

Examples of such materials are sold under the trade names Polytergent SLF 18 and Polytergent SLF 18B.

(c) The Optional Hydrophobic Solvent

In order to obtain the best cleaning, especially of lipid soils, it is necessary to use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metal-working industry. The level of hydrophobic solvent is preferably, and typically, from about 1% to about 15%, preferably from about 2% to about 12%, most preferably from about 5% to about 10%.

Many of such solvents comprise hydrocarbon or halogenated hydrocarbon moieties of the alkyl or cycloalkyl type, and have a boiling point well above room temperature, i.e., above about 20° C.

The formulator of compositions of the present type will select a solvent, or solvents, partly by the need to provide good grease-cutting properties, and partly by aesthetic considerations.

Generically, the glycol ethers useful herein have the formula $R^1\ O(R^2O)_mH$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, monoethylene glycolmonobutyl ether, and mixtures thereof.

The monopropyleneglycolmonobutyl ether (butoxy-propanol) solvent should have no more than about 20%, preferably no more than about 10%, more preferably no more than about 7%, of the secondary isomer in which the butoxy group is attached to the secondary atom of the propanol for improved odor.

Solvents for these hard surface cleaner compositions can also comprise diols having from 6 to about 16 carbon atoms in their molecular structure. Preferred diol solvents have a solubility in water of from about 0.1 to about 20 g/100 g of water at 20° C. The diol solvents in addition to good grease cutting ability, impart to the-compositions an enhanced ability to remove calcium soap soils from surfaces such as bathtub and shower stall walls. These soils are particularly difficult to remove, especially for compositions which do not contain an abrasive.

Other solvents such as benzyl alcohol, n-hexanol, and phthalic acid esters of $C_{1-4}$ alcohols can also be used.

Terpene solvents and pine oil, are usable, but are preferably not present.

(d) The Polycarboxylate Detergent Builder

Polycarboxylate detergent builders useful herein, include the builders disclosed in U.S. Pat. No. 4,915,854, Mao et al., issued Apr. 10, 1990, said patent being incorporated herein by reference. Suitable detergent builders preferably have relatively strong binding constants for calcium under acid conditions.

Preferred detergent builders include dicarboxylic acids having from about 2 to about 14, preferably from about 2 to about 4, carbon atoms between the carboxyl groups. Specific dicarboxylic detergent builders include succinic, glutaric, and adipic acids, and mixtures thereof. Such acids have a $pK_1$ of more than about 3 and have relatively high calcium salt solubilities. Substituted acids having similar properties can also be used.

These dicarboxylic detergent builders provide faster removal of the hard water soils, especially when the pH is between about 2 and about 4.

Other suitable builders that can be used include: citric acid, and, especially, builders having the generic formula:

$$R^5—[O—CH(COOH)CH(COOH)]_nR^5$$

wherein each $R^5$ is selected from the group consisting of H and OH and n is a number from about 2 to about 3 on the average. Other preferred detergent builders include those described in the U.S. Pat. No. 5,051,212, Culshaw and Vos, issued Sep. 24, 1991, for "Hard-Surface Cleaning Compositions," said patent being incorporated herein by reference.

In addition to the above detergent builders, other detergent builders that are relatively efficient for hard surface cleaners and/or, preferably, have relatively reduced filming/streaking characteristics include the acid forms of those disclosed in U.S. Pat. No. 4,769,172, Siklosi, issued Sep. 6, 1988, and incorporated herein by reference. Still others include the chelating agents having the formula:

$$R—N(CH_2COOM)_2$$

wherein R is selected from the group consisting of: $—CH_2CH_2CH_2OH$; $—CH_2CH(OH)CH_3$; $—CH_2CH(OH)CH_2OH$; $—CH(CH_2OH)_2$; $—CH_3$; $—CH_2CH_2OCH_3$;

$$—\underset{\underset{O}{\|}}{C}—CH_3;\quad —CH_2—\underset{\underset{O}{\|}}{C}—NH_2;$$

$—CH_2CH_2CH_2OCH_3$; $—C(CH_2OH)_3$; and mixtures thereof; and each M is hydrogen.

The chelating agents of the invention are present at levels of from about 2% to about 14% of the total composition, preferably about 3% to about 12%, more preferably from about 5% to about 10%.

The acidic detergent builders herein will normally provide the desired pH in use. However, if necessary, the composition can also contain additional buffering materials to give a pH in use of from about 1 to about 5.5, preferably from about 2 to about 4.5, more preferably from about 2 to about 4. pH is usually measured on the product. The buffer is selected from the group consisting of: mineral acids such as HC1, HN03, etc., and organic acids such as acetic, etc., and mixtures thereof. The buffering material in the system is important for spotting/filming. Preferably, the compositions are substantially, or completely free of materials like oxalic acid that are typically used to provide cleaning, but which are not desirable from a safety standpoint in compositions that are to be used in the home, especially when very young children are present.

The Aqueous Solvent System

The balance of the formula is typically water. Nonaqueous polar solvents with only minimal cleaning action like methanol, ethanol, isopropanol, ethylene glycol, propylene- glycol, and mixtures thereof are usually not present. When the nonaqueous solvent is present, the level of nonaqueous polar solvent is from about 0.5% to about 10%, preferably less than about 5% and the level of water is from about 50% to about 97%, preferably from about 75% to about 95%.

Optional Ingredients

The compositions herein can also contain other various adjuncts which are known to the art for detergent compositions so long as they are not used at levels that cause unacceptable spotting/filming. Nonlimiting examples of such adjuncts are:

Anionic detergent surfactant;

Enzymes such as proteases;

Thickeners such as xanthan gums, e.g., Keltrol, or Keltrol RD, typically at a level of from about 0.01% to about 2%, preferably from about 0.05% to about 0.5%;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Optional Anionic Detergent Surfactant

Typical optional anionic detergent surfactants are the alkyl- and alkylethoxylate-(polyethoxylate) sulfates, paraffin sulfonates, olefin sulfonates, alpha-sulfonates of fatty acids and of fatty acid esters, and the like, which are well known from the detergency art. In general, such detergent surfactants contain an alkyl group in the $C_9$–$C_{22}$, preferably $C_{10-18}$, more preferably $C_{12-16}$, range. The anionic detergent surfactants can be used in the form of their sodium, potassium or alkanolammonium, e.g., triethanolammonium salts. $C_{12}$–$C_{18}$ paraffin-sulfonates and alkyl sulfates are especially preferred in the compositions of the present type.

The anionic detergent surfactant, in combination with said nonionic detergent surfactant described hereinbefore, at a ratio that is typically from about 1:3 to about 3:1, preferably from about 1:2 to about 2:1, provides a thicker product.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The optional anionic detergent cosurfactant component can comprise as little as 0.001% of the compositions herein when it is present, but typically the compositions will contain from about 0.01% to about 10%, more preferably from about 0.02% to about 8%, of anionic detergent cosurfactant, when it is present. Anionic detergent surfactants are desirably not present, unless as part of a self-thickening formula, or are present only in limited amounts to promote rinsing of the surfaces. When the anionic detergent surfactant is used as part of a self-thickening formula, it is typically present at a level of from about 1% to about 10%, preferably at a level of from about 2% to about 8%.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are readily solubilized in the compositions by the nonionic and zwitterionic detergent surfactants. Anionic detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Selection of any particular perfume ingredient is primarily dictated by aesthetic considerations, but more water-soluble materials are preferred, as stated hereinbefore, since such materials are less likely to adversely affect the good spotting/filming properties of the compositions.

These compositions have exceptionally good cleaning properties. They also have good "shine" properties, i.e., when used to clean glossy surfaces, without rinsing, they have much less tendency than e.g., phosphate built products to leave a dull finish on the surface.

In a preferred process for using the products described herein, and especially those formulated to be used at full strength, the product is sprayed onto the surface to be cleaned and then wiped off with a suitable material like cloth, a paper towel, etc. It is therefore highly desirable to package the product in a package that comprises a means for creating a spray, e.g., a pump, aerosol propellant and spray valve, etc.

All parts, percentages, and ratios herein are "by weight" unless otherwise stated.

The invention is illustrated by the following Examples.

EXAMPLE I

| Ingredient | A Wt. % | B Wt. % | C Wt. % |
|---|---|---|---|
| 3-(N-dodecyl-N,N-dimethyl)-2-hydroxy-propane-1-sulfonate (DDHPS)[1] | 2.0 | — | — |
| $C_{9-11}$ Polyethoxylate (6) (C91E6)[2] | 2.0 | — | — |
| $C_8E6$[3] | — | 2.0 | 2.0 |
| Cocoamido propyl betaine[4] | — | 2.0 | 2.0 |
| BPP | 6.0 | 5.0 | 4.0 |
| Citric Acid | 4.5 | 6.0 | 7.0 |
| Polytergent SLF18 | — | 0.5 | 0.5 |
| SCS | 3.25 | 2.75 | 2.0 |
| Water, Buffering Agents, Thickener, and Minors | | up to 100 | |
| pH | 2.99 | 2.97 | 3.0 |

[1]Varion CAS
[2]Neodol 91-6
[3]Surfonic L8-6
[4]Betaine AMB-15

When tested under the same conditions, the formulas B and C provide essentially the same greasy soap scum cleaning, improved cleaning of hardness deposits, and much less suds, thus improving the rinsing of the suds.

EXAMPLE II

| Ingredient | Glycinates A Wt. % | B Wt. % | C Wt. % |
|---|---|---|---|
| 3-(N-dodecyl-N,N-dimethyl)-2-hydroxy-propane-1-sulfonate (DDHPS)[1] | 2.0 | — | — |
| $C_{9-11}$ Polyethoxylate (6) (C91E6)[2] | 2.0 | 2.0 | 2.0 |
| $C_{8-10}$ E6 | — | 2.0 | 2.0 |
| Lauroamphoglycinate[3] | — | 2.0 | — |
| Tallow Glycinate[4] | — | — | 2.0 |
| BPP | 8.0 | 8.0 | 8.0 |
| Citric Acid | 6.0 | 6.0 | 6.0 |
| SCS | 3.0 | 3.0 | 3.0 |
| Polytergent SLF18 | 0.5 | 0.5 | 0.5 |
| Water, Buffering Agents, and Minors | | up to 100 | |
| pH | 2.95 | 3.23 | 3.05 |

[1]Varion CAS
[2]Neodol 91-6
[3]Rewoteric AM 2L-35
[4]Rewoteric AM TEG

What is claimed is:

1. An acidic aqueous hard surface detergent composition comprising: (a) a detergent surfactant system which comprises either: (1) a mixture of from about 0.01% to about 8% of (i) amphoteric, non-zwitterionic, detergent surfactant having the generic formula

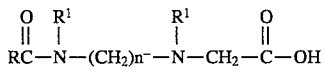

wherein

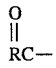

is a $C_{8-14}$ hydrophobic fatty acyl moiety containing from about 8 to about 14 carbon atoms which, in combination with the nitrogen atom, forms an amido group, each n is from 1 to 3, and each $R^1$ is hydrogen or a $C_{1-2}$ alkyl or hydroxy alkyl group, with (ii) from about 0.01% to about 6% of nonionic detergent surfactant which contains a $C_{7-22}$ alkyl group and from about 2.5 to about 2.5 to about 12 ethylene oxide groups to give an HLB of from about 8 to about 16; or (2) from 0.1% to about 15% of a sudsing, nonionic detergent surfactant that is a $C_{7-10}EO_{3-12}$ nonionic detergent surfactant (b) at least a suds reducing amount and less than about 5% of a suds controlling alkoxylated material of the formula: $C_n(PO)_x(EO)_y(PO)_z$ in which EO stands for ethylene oxide, PO stands for propylene oxide, $C_n$ is a hydrocarbon group containing n carbon atoms, n is a number from about 6 to about 12, x is a number from about 1 to about 6, y is a number from about 4 to about 15, and z is a number from about 4 to about 25, (c) optionally, from about 1% to about 15% of hydrophobic solvent that provides a primary cleaning function; and (d) from about 2% to about 14% of polycarboxylate detergent builder, and said composition having a pH of from about 1 to about 5.5.

2. The composition of claim 1 wherein said nonionic detergent surfactant of (2) is either $C_8$, or mixture of $C_{8\ and\ 10}$, alkyl nonionic detergent surfactants with the $C_8$ being at least about 10% of the mixture.

3. The composition of claim 2 containing from about 1% to about 15% of said organic solvent (c), said solvent having a solubility in water of less than about 20%.

4. The composition of claim 3 wherein said organic solvent (c) is selected from the group consisting of: benzyl alcohol, glycol ethers, and diols containing 6 to 16 carbon atoms.

5. The composition of claim 4 wherein said solvent (c) has the formula $R^1O\text{-}(R^2O)_mH$ wherein each $R^1$ is an alkyl group which contains from about 4 to about 8 carbon atoms, each $R^2$ is selected from the group consisting of ethylene or propylene, and m is a number from 1 to about 3.

6. The composition of claim 1 wherein said polycarboxylic acid detergent builder consists essentially of dicarboxylic acid detergent builder which has from about 2 to about 4 carbon atoms between the carboxyl groups.

7. The composition of claim 1 containing from about 0.1% to about 5% of said suds controlling alkoxylated material (b), in which said n is from about 6 to about 10, said x is from about 2 to about 4, said y is from about 5 to about 12, and said z is from about 6 to about 20.

8. The composition of claim 7 containing from about 1% to about 15% of said organic solvent (c), said solvent having a solubility in water of less than about 20% and wherein said organic solvent (c) is selected from the group consisting of: benzyl alcohol, glycol ethers, and diols containing 6 to 16 carbon atoms.

9. The composition of claim 8 wherein said solvent c) has the formula $R^1O\text{-}(R^2O)_mH$ wherein each $R^1$ is an alkyl group which contains from about 4 to about 8 carbon atoms, each $R^2$ is selected from the group consisting of ethylene or propylene, and m is a number from 1 to about 3.

10. The composition of claim 9 wherein said solvent (c) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

11. The composition of claim 1 wherein said detergent surfactant system (a) is (1) a mixture of amphoteric-non zwittterionic and nonionic detergent surfactants.

12. The composition of claim 11 containing from about 1% to about 15% of said organic solvent (c), said solvent having a solubility in water of less than about 20%.

13. The composition of claim 12 wherein said organic solvent (c) is selected from the group consisting of: benzyl alcohol, glycol ethers, and diols containing 6 to 16 carbon atoms.

14. The composition of claim 13 wherein said solvent (c) has the formula $R^1O\text{-}(R^2O)_mH$ wherein each $R^1$ is an alkyl group which contains from the about 4to about 8 carbon atoms, each $R^2$ is selected from the group consisting of ethylene or propylene, and m is a number from 1 to about 3.

15. The composition of claim 11 wherein said hydrophobic fatty acyl moiety contains from about 8 to about 10 carbon atoms.

16. The composition of claim 1 containing as an additional ingredient, an anionic detergent surfactant at a level of from about 1% to about 10%, the ratio of nonionic detergent surfactant to anionic detergent surfactant being from about 1:3 to about 3:1.

17. The composition of claim 1 containing as an additional ingredient, an anionic detergent surfactant at a level of from about 2% to about 8%, the ratio of nonionic detergent surfactant to anionic detergent surfactant being from about 1:2 to about 2:1.

18. The process of cleaning hard surfaces comprising spraying said surfaces with the composition of claim 1.

* * * * *